US005594197A

United States Patent [19]

Lindstadt et al.

[11] Patent Number: 5,594,197

[45] Date of Patent: Jan. 14, 1997

[54] SECONDARY PROJECTILE FOR A TANDEM WARHEAD

[75] Inventors: Klaus Lindstädt, Schwaig; Manfred Klare, Simmelsdorf, both of Germany

[73] Assignee: Diehl GmbH & Co., Nurnberg, Germany

[21] Appl. No.: 540,935

[22] Filed: Oct. 11, 1995

[30] Foreign Application Priority Data

Sep. 15, 1995 [DE] Germany ..... 195 34 211.9

[51] Int. Cl.[6] ..... F42B 12/20

[52] U.S. Cl. ..... 102/499; 102/473; 102/476; 102/494

[58] Field of Search ..... 102/308, 389, 102/393, 396, 397, 473, 476, 478, 491–497, 499, 500

[56] References Cited

U.S. PATENT DOCUMENTS

| | | | |
|---|---|---|---|
| 94,647 | 9/1869 | Richards | 102/478 |
| 4,803,928 | 2/1989 | Kramer et al. | 102/476 |

FOREIGN PATENT DOCUMENTS

| | | | |
|---|---|---|---|
| 0583642A1 | 2/1994 | European Pat. Off. . | |
| 317581 | 12/1919 | Germany | 102/494 |
| 3703773 | 8/1988 | Germany | 102/491 |
| 3941445A1 | 6/1991 | Germany . | |
| 3941445 | 6/1991 | Germany | 102/496 |
| 113414 | 3/1945 | Sweden | 102/478 |

*Primary Examiner*—Harold J. Tudor
*Attorney, Agent, or Firm*—Scully, Scott, Murphy & Presser

[57] ABSTRACT

The present invention relates to a secondary projectile for a tandem warhead including a forwardly located active charge, a rearwardly located active charge and a fuze which is arranged therebetween, and whose triggering direction is oriented towards the forwardly located active charge, whereby the transmission of the ignition or triggering is implemented forwardly through the intermediary of a booster charge and towards the rear through the use of a cross-triggering device. The booster charge which is triggered by the fuze consists of an explosive material and lies directly against the forwardly located active charge, and wherein the booster charge at the other side thereof is separated by thin cross-ignitable wall segments of a housing of the cross-triggering device from at least two tongue-shaped explosive material poles of the rearwardly located active charge.

5 Claims, 2 Drawing Sheets

Fig.1
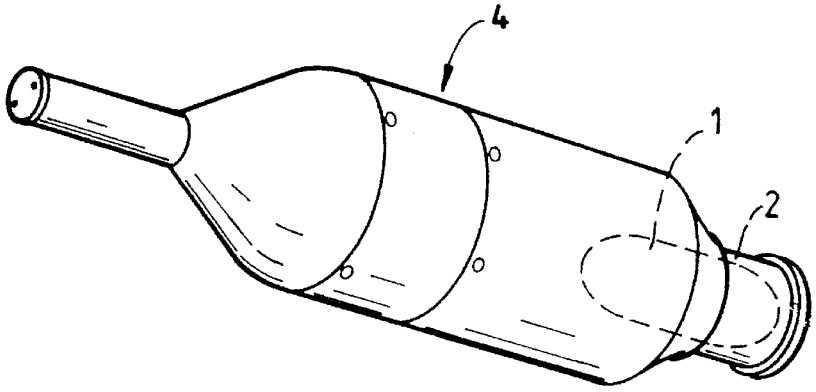
Fig.3
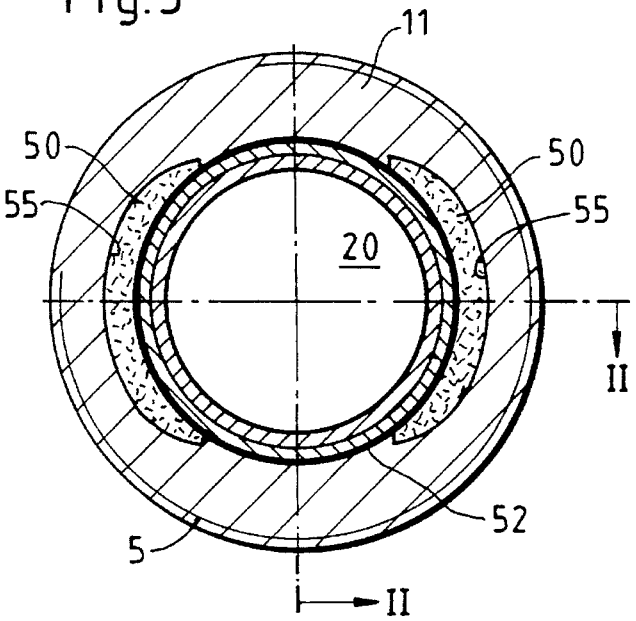
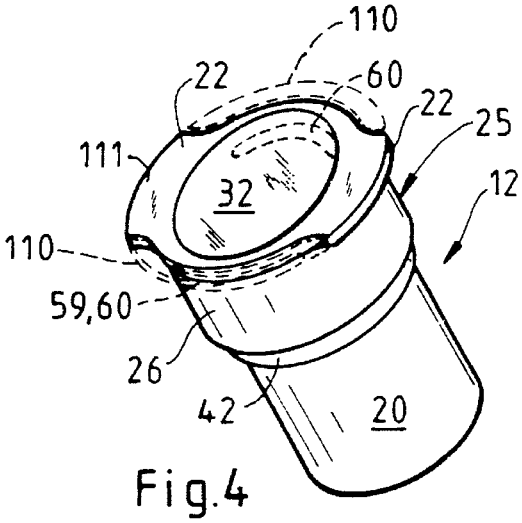
Fig.4
Fig.5
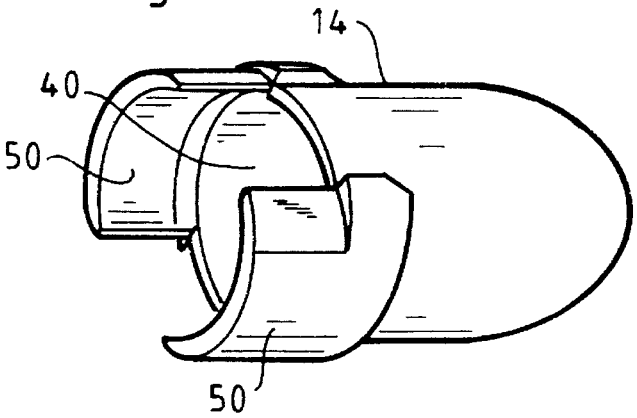

SECONDARY PROJECTILE FOR A TANDEM WARHEAD

BACKGROUND OF THE INVENTION

1. Field of the Invention

The present invention relates to a secondary projectile for a tandem warhead including a forwardly located active charge, a rearwardly located active charge and a fuze which is arranged therebetween, and whose triggering direction is oriented towards the forwardly located active charge, whereby the transmission of the ignition or triggering is implemented forwardly through the intermediary of a booster charge and towards the rear through the use of a cross-triggering device.

2. Discussion of the Prior Art

During house-to-house or urban combat or in action against various kinds of coverings for enemy forces, there is a need for the provision of inexpensive weapons and ammunition. Through the disclosure of published European Patent No. A1-058 63 642, there is already known a warhead which incorporates a tandem charge. The warhead possesses a main or primary charge which is constructed as a hollow charge and a smaller-caliber follow-up charge. Upon the warhead striking against the target, the hollow charge punches a passageway through the target. The secondary projectile, which is constructed as a fragmentation projectile, penetrates through this passageway into the target and detonates behind the target with a fragmentation effect. The secondary projectile is conveyed through the passageway on the basis alone of its inertial force upon the impact of the warhead. There is no requirement for a separate accelerating charge for the secondary projectile. The fragmentation effect is caused by means of the explosive charge and through the housing of the secondary projectile. Because of the construction of the secondary projectile, the fragmentation effect lies primarily in the firing direction, whereby in immediate close proximity to the covering there is produced an only minor fragmentation effect.

In order to improve the fragmentation effect in opposition to the direction of flight of a projectile, in accordance with German Patent Publication No. DE-A1 39 41 445 provision is made that in addition to the fragments present in a nose cone of a projectile, there are provided an explosive charge and nose cone configuredly arranged constructional fragments in the tail end of the projectile. The triggering of the explosive charge at the tail end is effected by means of a centrally located fuze, whereby this fuze separates the forwardly located explosive charge from the rearwardly located explosive charge. The forward explosive charge is triggered through a detonating booster, whereas the rear explosive requires a transfer detonator and behind thereof a detonating transmitter. This detonating transmitter eccentrically initiates the explosive charge at the tail end, in effect, at the outer edge of the explosive charge. Through this one-sided triggering of the explosive charge which is somewhat configured as a hemisphere, there is generated an extremely differing fragment density in the target space. Moreover, the energy of the constructional fragments will correspondingly vary.

SUMMARY OF THE INVENTION

Accordingly, it is an object of the present invention to provide for the transmission of the triggering from a fuze having only one triggering exit to the forwardly located and the rearwardly located active charges of a secondary projectile, and which resultingly leads to an increased fragmentation effect. This transmission of the triggering or detonation is intended to be constructively simple and inexpensive.

The present invention attains the foregoing object in that a booster charge which is triggered by the fuze consists of an explosive material and lies directly against the forwardly located active charge, and wherein the booster charge at the other side thereof is separated by thin cross-ignitable wall segments of a housing of the cross-triggering device from at least two tongue-shaped explosive material poles of the rearwardly located active charge.

Further advantageous modifications of the invention may be readily ascertained from the detailed description as set forth hereinbelow.

Essential to the invention is the symmetrical and large-surfaced triggering transmission towards the rearwardly located active charge. As a result thereof, the effectiveness of the rearwardly located active charge corresponds with that of the forwardly located active charge. A special advantage resides in the large-surfaced triggering of the forwardly located active charge. An operationally-reliable transmission of the triggering is provided by means of the inventive features. The thin wall segments of the cross-triggering arrangement, which separate the booster charge consisting of explosive material from the tongue-shaped explosive material poles of the rear active charge, afford the simultaneous triggering of the last mentioned poles.

BRIEF DESCRIPTION OF THE DRAWINGS

Reference may now be had to the following description of an exemplary embodiment of the invention, taken in conjunction with the accompanying drawings; in which:

FIG. 1 illustrates, in a perspective representation, a tandem warhead with a phantom line-drawn secondary projectile;

FIG. 3 illustrates a cross-sectional view through the secondary projectile, taken along line III—III in FIG. 2;

FIG. 4 illustrates the complete fuze pursuant to FIG. 2, shown in a perspective representation; and FIG. 5 illustrates a perspective view of an active charge pursuant to FIG. 2.

DETAILED DESCRIPTION OF A PREFERRED EMBODIMENT

Figure 2:
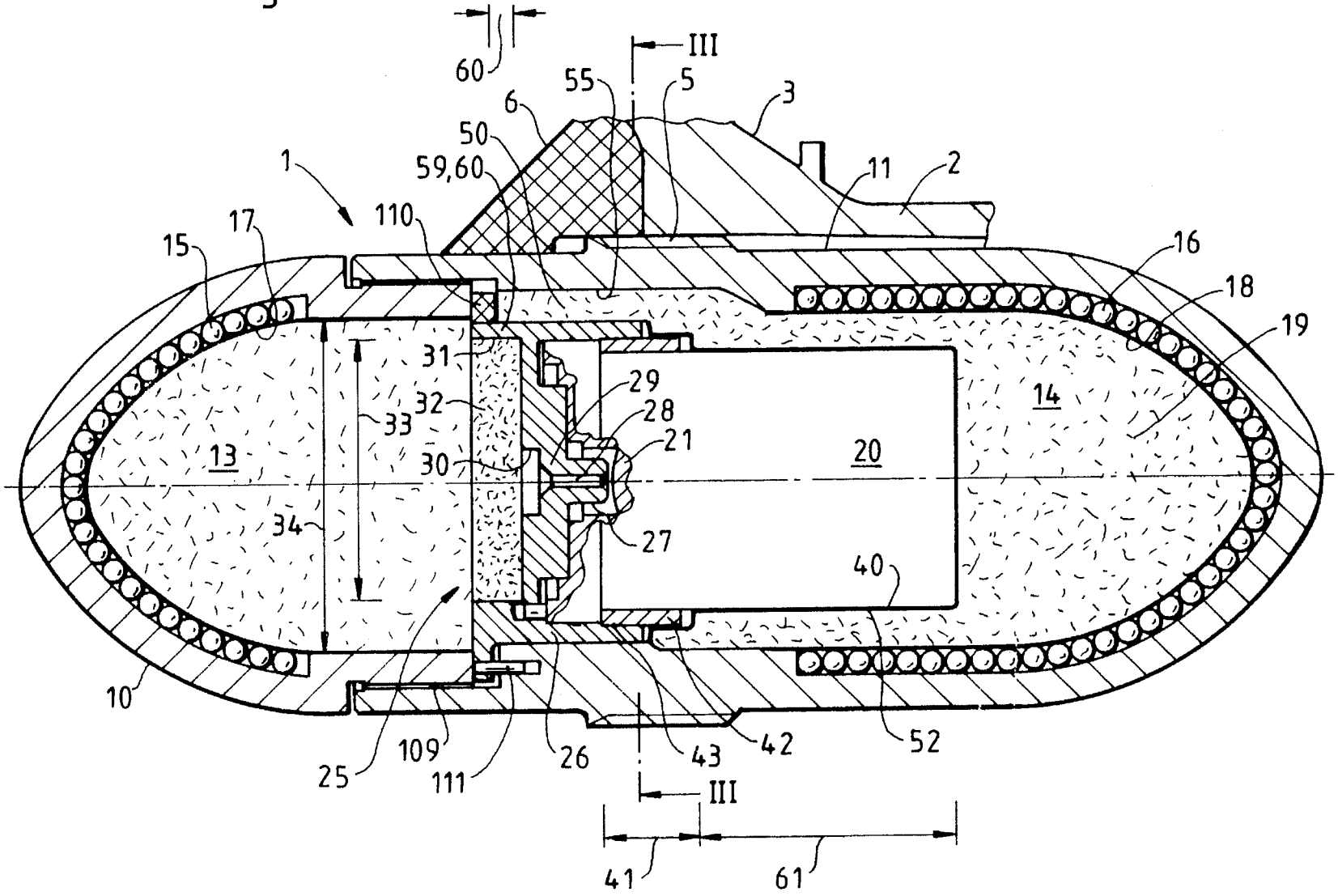
FIG. 2 illustrates the secondary projectile in a longitudinal sectional view with a portion of the housing of the tandem warhead, taken along line II—II in FIG. 3.

In accordance with FIGS. 1 and 2, a secondary projectile 1 is located in an only partly illustrated tubular section 2 of a housing 3 of a tandem warhead 4 and secured through a screwthreaded connection 5. A protector against gas clouds from explosives is designated by reference numeral 6.

The secondary projectile 1 is constituted of two housing parts 10, 11 which are secured together by screwthreads at location 109, a fuze 12, a two-part explosive charge 13, 14, and of fragmentation charges 15, 16 with casings 17, 18.

The fuze 12 pursuant to FIGS. 2 and 4 consists of an electrically-actuatable triggering device 20 with a detonator 21, a screwthread 42 and a cross-triggering arrangement 25 which is screwed together with the triggering device 20.

The cross-triggering arrangement 25 includes a housing 26 with two peripherally spaced flanges 22 and with a central trunnion 27 at the side facing towards the fuze.

Arranged in the housing 26 are cut-outs 28 through 31 with a booster charge 32 consisting of an explosive.

The booster charge 32 is constructed disk-shaped in the direction facing towards the forwardly located active charge 13 and possesses a diameter 33 which almost corresponds with the diameter 34 of the forwardly located active charge 13.

The rearwardly located active charge 14, as is also illustrated in FIG. 5, receives the fuze 20 in a bore 40 extending up to an annular section 41. In this region there is located a screwthreaded ring 42 of the fuze 20, whereby the latter is screwed together with the housing 26 through a screwthreaded connection 43.

Unitarily connected with the rearwardly located active charge 14 are two peripherally spaced tongue-like or arcuately curved plates forming explosive material poles 50. Inasmuch as the fuze 12 is completely arranged within a cylindrical metal casing 52 which is constituted of aluminum, the space which is necessary for the explosive material poles 50 is created by means of corresponding cut-outs or recesses 55 in the housing part 11. The metal casing 52 completely encapsulates the rearwardly located active charge 14. An elastic element located intermediate each of the flanges 22 and extending peripherally between the housing parts 10 and 11 is designated with reference numeral 110. One of the flanges 22 is pinned in place at 111.

In the cross-triggering region 60 there are provided two thinly constructed wall segments 59 on the housing 26, so that the cross-triggering can take place from the booster charge 32 to the explosive material poles 50; in effect, along two paths.

The cross-section of the explosive material poles 50 are dimensioned in such a manner that there is afforded the through-ignition to the explosive material block 19 of the rearwardly located active charge 14.

Upon the striking of the tandem warhead 4 against a covering (not shown) through the intermediary of a hollow charge (also not shown), there is created a through-passageway in the covering. The secondary projectile which is released from the housing 3 penetrates through this through-passageway. Due to a suitably set time delay, the detonator 21 of the fuze 20 triggers the booster charge 32. Commencing from the booster charge 32, there is triggered the forwardly located active charge 13 and simultaneously the explosive material poles 50, in that there is penetrated through the housing 26 in the cross-triggering regions 60. The mutually oppositely-located explosive material poles 50 conduct the explosive impulse symmetrically across a neck region 61 to the explosive material block 19. The simultaneous detonation of the forward and the rearward active charges 13, 14 thereby leads to a forward fragment distribution as well as also to a rearward fragment distribution. The fragment distribution caused by the rearward active charge 14 is large just in the direction towards the through-passageway and its surrounding area.

What is claimed is:

1. A generally cylindrical secondary projectile for a tandem warhead, said secondary projectile containing a forward active charge, a rearward active charge; a fuze extending between said charges and having a triggering direction oriented towards the forward active charge, said fuze being substantially located within said rearward active charge, a booster charge located between said fuze and said forward active charge for directing the triggering transmission forwardly; and cross-triggering means operatively connected with said booster charge for directing the triggering transmission rearwardly, said booster charge being activatable by said fuze and consisting of an explosive material lying in direct contact with the forward active charge, the booster charge on peripheral surface portions thereof being separated by cross-triggerable wall sections of a housing of the cross-triggering means from at least two peripherally spaced and axially forwardly extending plate-shaped explosive material poles of the rearward active charge.

2. A secondary projectile according to claim 1, wherein the explosive material poles are integrally formed with the rearward active charge and form cross-triggering regions together with the booster charge.

3. A secondary projectile according to claim 1, wherein the explosive material poles are in extensive surface contact with a metal casing encompassing the fuze in the region of the housing of the cross-triggering means, and are bounded in a radial direction by a housing part of the rearward active charge.

4. A secondary projectile according to claim 3, wherein the housing part includes cut-outs dimensioned in conformance with the explosive material poles.

5. A secondary projectile according to claim 1, wherein the booster charge is disk-shaped and has a diameter which generally corresponds with the diameter of the forward active charge.

* * * * *